US005359856A

United States Patent [19]

Rhoades et al.

[11] Patent Number: 5,359,856

[45] Date of Patent: Nov. 1, 1994

[54] PROCESS FOR PURIFYING LIQUID NATURAL GAS

[75] Inventors: George D. Rhoades, LaGrange; Ronald C. Weber, Brookfield; Gerald E. Engdahl, Wheaton, all of Ill.

[73] Assignee: Liquid Carbonic Corporation, Oak Brook, Ill.

[21] Appl. No.: 133,667

[22] Filed: Oct. 7, 1993

[51] Int. Cl.[5] ..... F25J 1/00

[52] U.S. Cl. ..... 62/9; 62/40

[58] Field of Search ..... 62/9, 40

[56] References Cited

U.S. PATENT DOCUMENTS 3,358,460 12/1967 Smith et al. ..... 62/9
3,407,052 10/1968 Huntress et al. ..... 62/9
3,616,652 11/1971 Engel ..... 62/9

*Primary Examiner*—Ronald C. Capossela
*Attorney, Agent, or Firm*—Fitch, Even, Tabin & Flannery

[57] ABSTRACT

The present invention is directed to a process for increasing the methane content of liquid natural gas to provide an essentially pure liquid methane product. In the process, a liquid natural gas feed stream is introduced into a first heat exchanger in indirect heat exchange with a purified methane vapor stream so as to liquify the purified methane vapor stream and to provide a purified liquid methane product. The heat exchange results in increasing the temperature of the liquid natural gas feed stream to a temperature just below the dew point of the liquid natural gas feed stream so as to partially vaporize the liquid natural gas feed stream to provide a mixture of a major amount of substantially pure methane vapor and a minor amount of liquid containing methane and higher hydrocarbons. The mixture of vapor and liquid from the first heat exchanger is transferred to a low pressure separator to provide a liquid bottom fraction and a purified methane top vapor fraction. At least a portion of the liquid bottom fraction and all of the top vapor fraction are transferred to a second heat exchanger in indirect heat exchange with the vapor fraction after the vapor fraction has been processed to change the temperature and pressure of the vapor fraction.

11 Claims, 1 Drawing Sheet

PROCESS FOR PURIFYING LIQUID NATURAL GAS

FIELD OF THE INVENTION

The present invention is directed to a process for increasing the methane content of liquid natural gas to provide an essentially pure liquid methane product. More particularly, the present invention is directed to a method for purifying liquid natural gas utilizing the inherent refrigeration capacity of the liquid natural gas as a component in the purifying process.

BACKGROUND OF THE INVENTION

Liquid natural gas qualifies as a desirable alternative fuel for internal combustion engines. A major problem associated with the use of liquid natural gas as a fuel for internal combustion engines is that liquid natural gas is a mixture of about 90 to 95% methane with higher molecular weight hydrocarbons, which are called higher hydrocarbons. The principal higher hydrocarbon is ethane, usually in the range of from about 4% to about 7%.

The hydrocarbons higher than methane create several problems for the utilization of liquid natural gas as a fuel for internal combustion engines. First, the higher hydrocarbons have lower auto ignition temperatures than methane.

| Component | Critical Compression Ratio | Auto Ignition Temperature |
|---|---|---|
| Methane | 13.0 | 540° C. |
| Ethane | 9.8 | 515° C. |
| Propane | 8.8 | 450° C. |
| Butane | 5.3 | 405° C. |
| Pentane | 3.5 | 260° C. |

The composition of natural gas varies widely dependent on the source, Such variation in composition denies engine manufacturers the opportunity to maximize engine designs. The higher hydrocarbons in the liquid natural gas fuel can cause preignition which can cause knock, hot spots and eventually engine failure.

Many processes have been devised for the cryogenic separation from heavier components in a natural gas stream from methane and for cryogenic refrigeration. Among these are U.S. Pat. Nos. 4,072,485 to Becdelievre, et al.; 4,022,597 to Bacon; 3,929,438 to Harper; 3,808,826 to Harper, et al.; Re. 29,914 to Perret; Re 30,085 to Perret; 3,414,819 to Grunberg, et al.; 3,763,658 to Gaumer, Jr., et al.; 3,581,510 to Hughes; 4,140,504 to Campbell, et al.; 4,157,904 to Campbell, et al.; 4,171,964 to Campbell, et al.; 4,278,457 to Campbell, et al.; 3,932,154 to Coers, et al.; 3,914,949 to Maher, et al. and 4,033,735 to Swenson.

Such prior art processes for separation of heavier components from methane utilize complex heat exchange schemes usually involving fractionation in a distillation column. They also start with a natural gas feed stream in the vapor state. Exemplary of such processes is U.S. Pat. No. 4,738,699 to Apffel. The Apffel patent discloses a method for use of a mixed refrigerant refrigeration stream for removing higher hydrocarbons from methane of a natural gas stream. The mixed refrigerant refrigeration system is used to facilitate separation of methane and lighter constituents of the natural gas stream from the higher hydrocarbon components, such as ethane, propane and heavier hydrocarbons. The separation process is accomplished with a fractionation tower, where the methane and lighter gases are separated from the other hydrocarbons using indirect heat exchange with a mixed refrigerant, and a slip stream from the initial feed stream, alternately to provide the energy for distillation.

It is a principle object of the present invention to provide a simple means for providing a purified liquid methane product suitable for use in internal combustion engines from a liquid natural gas source utilizing the liquid natural gas source as the principal refrigerant for the purification and the liquefication of the natural gas.

SUMMARY OF THE INVENTION

Figure 1:
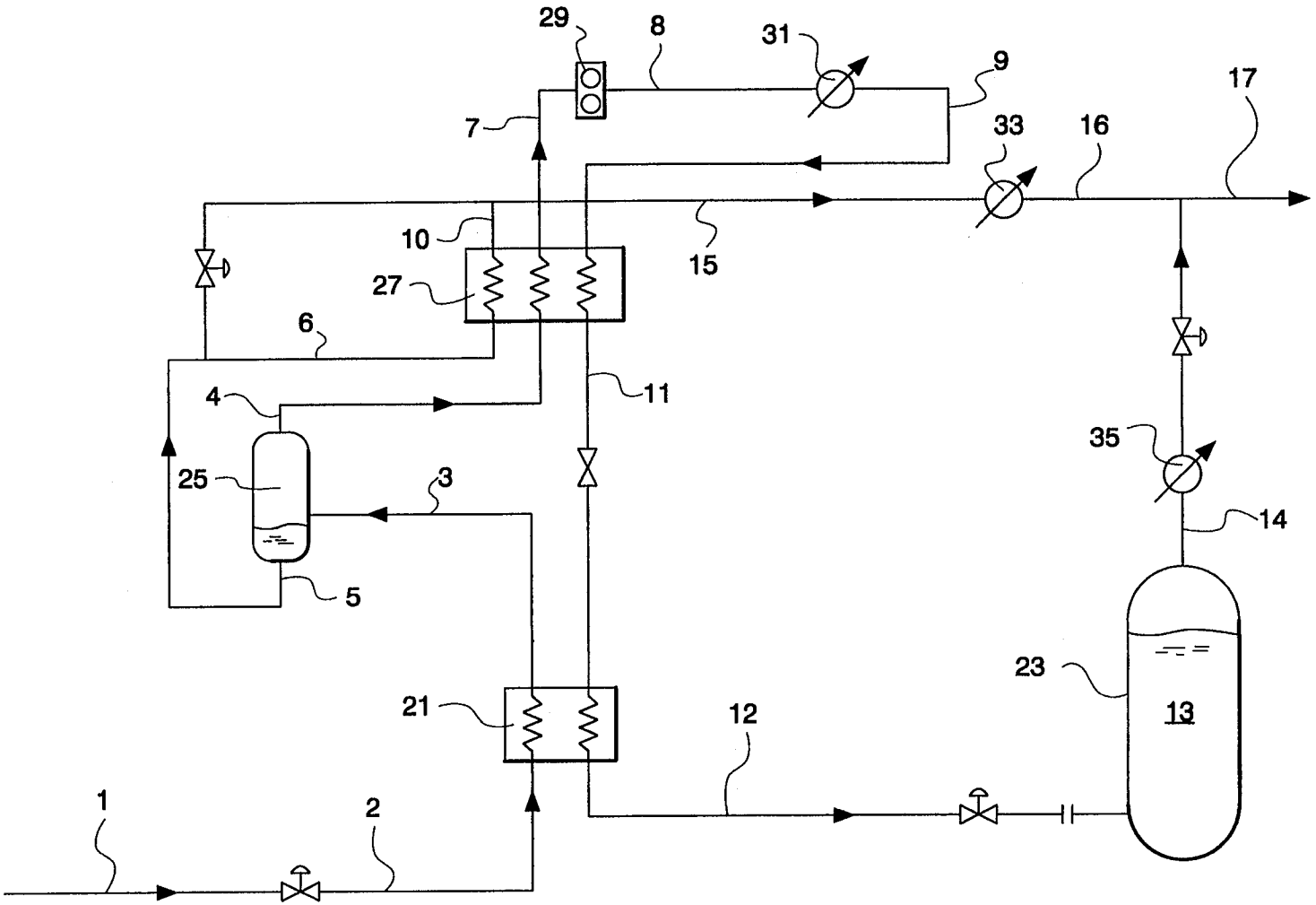
FIG. 1 is a flow sheet depicting the process of the present invention for purifying liquid natural gas into an essentially pure liquid methane product.

The present invention is directed to a process for increasing the methane content of liquid natural gas to provide an essentially pure liquid methane product. In the process, a liquid natural gas feed stream is introduced into a first heat exchanger in indirect heat exchange with a purified methane vapor stream so as to liquify the purified methane vapor stream and to provide a purified liquid methane product. The heat exchange results in increasing the temperature of the liquid natural gas feed stream to a temperature just below the dew point of the liquid natural gas feed stream so as to partially vaporize the liquid natural gas feed stream to provide a mixture of a major amount of substantially pure methane vapor and a minor amount of liquid containing methane and higher hydrocarbons. The mixture of vapor and liquid from the first heat exchanger is transferred to a separator operating at low pressure to provide a liquid bottom fraction and a purified natural gas top vapor fraction. At least a portion of the liquid bottom fraction and all of the top vapor fraction are transferred to a second heat exchanger in indirect heat exchange with the vapor fraction after the vapor fraction has been processed to change the temperature and pressure of the vapor fraction as it passes through the second heat exchanger. The vapor fraction exiting from the second heat exchanger is transferred through a compressor and an aftercooler to provide a processed purified methane vapor fraction which is returned to the second heat exchanger for use as a heat exchange medium in the second heat exchanger. The processed vapor fraction after its return through the second heat exchanger is introduced into the first heat exchanger to provide a heat exchange medium for the partial vaporization of the liquid natural gas feed stream and to provide a purified liquid methane stream.

DETAILED DESCRIPTION OF THE INVENTION

The present invention is directed to a process for increasing the methane content of liquid natural gas with very low energy costs. The process utilizes the inherent refrigerant capacity of liquid natural gas to liquify a purified gas stream which is substantially pure methane. The heat capacity of the purified gas stream is sufficient to increase the temperature of the liquid natural gas feed stream to a point just below the dew point of the liquid natural gas feed stream to provide a mixture consisting of substantially pure methane vapor and a liquid fraction which contains liquid methane and substantially all of the higher hydrocarbons.

As shown in FIG. 1, a liquid natural gas feed stream 1 is reduced in pressure to a desired operating pressure of from about 15 to about 24 psia. The reduced pressure natural gas feed stream 2 is then transferred through a first heat exchanger 21 in indirect heat exchange with a purified natural gas vapor stream 11 which is substantially pure methane. During the heat exchange, the natural gas vapor stream 11 is liquified to provide a purified liquid methane stream 12. The purified liquid methane stream 12 contains greater than about 99% methane.

The liquid natural gas stream 2 is heated in heat exchanger 21 to a temperature just below the dew point of the liquid natural gas to partially vaporize the liquid natural gas stream so as to provide a mixture of a major amount of substantially pure methane vapor and a minor amount of a liquid fraction which consists of liquid methane and higher hydrocarbons. The vapor and liquid mixture 3 exiting from heat exchanger 21 is transferred to a separator 25. The separator 25 may be provided with baffle plates or other means to assist in separating the vapor and liquid mixture into a bottom liquid fraction and a top vapor fraction.

At least a portion of the liquid bottom fraction is introduced into a second heat exchanger 27. The top vapor fraction is also introduced into heat exchanger 27. The vapor fraction which exits from heat exchanger 27 is compressed in compressor 29 and is transferred through aftercooler heat exchanger 31 to reduce the temperature of the natural gas as it exits from the compressor 29. The compressed and cooled top vapor fraction stream 9 which exits from heat exchanger 31 is introduced into heat exchanger 27 in indirect heat exchange with the liquid fraction 6 and the top vapor fraction 4 from separator 25.

The top vapor fraction stream 11 which exits from heat exchanger 27 is then transferred to heat exchanger 21 for heat exchange with the incoming liquid natural gas feed stream 2. As previously described, the heat exchange with liquid natural gas feed stream 2 liquefies stream 11 which is essentially pure methane, to an essentially pure liquid methane stream 12. The portion of liquid bottom fraction 5 from separator 25, stream 13, which is not used in heat exchanger 27 is joined with stream 10, increased in temperature in heat exchanger 33 and transferred from the purification system for further processing.

The following Table 1 sets forth the operating range for the temperature and pressure of the various heat exchange streams utilized in the process of the present invention for purifying natural gas.

TABLE 1

| Stream No. | Description | Temp. Range °F. | Press. range Psia |
|---|---|---|---|
| 1 | LNG Feed Stream | −260 to −200 | 15 to 100 |
| 2 | LNG Feed to HE 21 | −260 to −225 | 15 to 56 |
| 3 | Feed Stream to Separator 25 | −260 to −220 | 14 to 55 |
| 4 | Vapor Stream to HE 27 | −260 to −220 | 14 to 55 |
| 5 | Liquid Stream from Separator 27 | −260 to −220 | 14 to 55 |
| 6 | Liquid Stream to HE 27 | −260 to −220 | 14 to 55 |
| 7 | Vapor Stream from HE 27 | −20 to 110 | 13 to 54 |
| 8 | Vapor Stream from Compressor 29 | 180 to 300 | 25 to 90 |
| 9 | Vapor Stream from HE 31 | 60 to 125 | 24 to 89 |
| 10 | Liquid Stream from HE 27 | −20 to 110 | 13 to 54 |
| 11 | Vapor Stream from HE 27 | −245 to −170 | 23 to 88 |
| 12 | LNG from HE 21 | −255 to −220 | 22 to 87 |
| 13 | Liquid Bypass Stream | −260 to −220 | 14 to 55 |
| 14 | Stream 10 Combined with Stream 13 | −240 to 60 | 13 to 54 |
| 15 | Vapor Outlet Stream | −20 to 80 | 12 to 53 |

The following Table 2 illustrates the operating parameters utilized to process about 18,000 gallons per day of a liquid natural gas feed stream when supplied at a pressure of 25 psia and a temperature of −251.7° F.

TABLE II

| Point No. | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| Flow (mol/hr) | 158.81 | 158.81 | 158.81 | 133.28 | 25.53 | 4.14 | 133.28 | 133.28 | 133.28 | 4.14 | 133.28 | 133.28 | 21.39 | 25.53 | 25.53 |
| (lbs/hr) | 2901.5 | 2901.5 | 2901.5 | 2145.9 | 755.6 | 122.28 | 2145.9 | 2145.9 | 2145.9 | 122.28 | 2145.9 | 2145.9 | 633.32 | 755.6 | 755.6 |
| Press. (psia) | 25 | 22 | 20 | 20 | 20 | 20 | 19 | 55 | 50 | 17 | 48 | 46 | 17 | 17 | 16 |
| Temp. (F.) | −251.7 | −251.7 | −226.1 | −226.1 | −226.1 | −226.1 | 60 | 180 | 117 | 60 | −203.8 | −246 | −229.5 | −184 | 0 |
| Comp. (mol %) | | | | | | | | | | | | | | | |
| C1 | 88.25 | 88.25 | 88.25 | 99.58 | 29.10 | 29.10 | 99.58 | 99.58 | 99.58 | 29.10 | 99.58 | 99.58 | 29.10 | 29.10 | 29.10 |
| C2 | 8.93 | 8.93 | 8.93 | 0.42 | 53.36 | 53.36 | 0.42 | 0.42 | 0.42 | 53.36 | 0.42 | 0.42 | 53.36 | 53.36 | 53.36 |
| C3 | 1.96 | 1.96 | 1.96 | 0.00 | 12.19 | 12.19 | 0.00 | 0.00 | 0.00 | 12.19 | 0.00 | 0.00 | 12.19 | 12.19 | 12.19 |
| iC4 | 0.35 | 0.35 | 0.35 | 0.00 | 2.18 | 2.18 | 0.00 | 0.00 | 0.00 | 2.18 | 0.00 | 0.00 | 2.18 | 2.18 | 2.18 |
| nC4 | 0.21 | 0.21 | 0.21 | 0.00 | 1.31 | 1.31 | 0.00 | 0.00 | 0.00 | 1.31 | 0.00 | 0.00 | 1.31 | 1.31 | 1.31 |
| nC5 | 0.05 | 0.05 | 0.05 | 0.00 | 0.31 | 0.31 | 0.00 | 0.00 | 0.00 | 0.31 | 0.00 | 0.00 | 0.31 | 0.31 | 0.31 |
| iC5 | 0.12 | 0.12 | 0.12 | 0.00 | 0.75 | 0.75 | 0.00 | 0.00 | 0.00 | 0.75 | 0.00 | 0.00 | 0.75 | 0.75 | 0.75 |
| C6+ | 0.13 | 0.13 | 0.13 | 0.00 | 0.81 | 0.81 | 0.00 | 0.00 | 0.00 | 0.81 | 0.00 | 0.00 | 0.81 | 0.81 | 0.81 |

The process of the present invention for making purified liquid methane is very economical, requiring as a major means of energy only the compressor 29. The total work provided in compressing the vapor fraction exiting from the second heat exchanger is from about 0.032 to about 0.053 horsepower per pound per hour of the methane feed stream fed to compressor 29.

What is claimed is:

1. A process for increasing the methane content of liquid natural gas to provide a substantially pure liquid methane product comprising:

(a) introducing a liquid natural gas stream into a first heat exchanger in indirect heat exchange with a purified methane vapor stream so as to liquefy said purified methane vapor stream to provide a substantially pure liquid methane product and to partially vaporize said liquid natureal gas stream to provide a mixture of a major amount of substantially pure methane vapor and a minor amount of liquid containing methane and higher molecular weight hydrocarbons;

(b) transferring said mixture of vapor and liquid from said first heat exchanger to a low pressure separator to provide a liquid bottom fraction and a substantially pure methane top vapor fraction;

(c) introducing at least a portion of said liquid bottom fraction and all of said vapor fraction into a second heat exchanger in indirect heat exchange with said vapor fraction after said vapor fraction has been processed in accordance with step (d);

(d) transferring said vapor fraction exiting from said second heat exchanger through a compressor and an aftercooler to provide the said processed top vapor fraction for use as a heat exchange medium in said second heat exchanger; and (e) introducing said processed top vapor fraction exiting from said second heat exchanger into said first heat exchanger to provide a heat exchange medium for said partial vaporization of said liquid natural gas and to provide said substantially pure liquid methane stream.

2. A process in accordance with claim 1 wherein said liquid natural gas feed stream is at a temperature of from about −260° F. to about −200° F. and a pressure of from about 15 psia to about 100 psia.

3. A process in accordance with claim 1 wherein said substantially pure methane stream entering said first heat exchanger is at a temperature of from about −245° F. to about −170° F. and a pressure of from 23 psia to about 88 psia.

4. A process in accordance with claim 1 wherein said liquid bottom fraction is from about 10 mole percent to about 20 mole percent based on said liquid natural gas feed stream.

5. A process in accordance with claim 1 wherein from about 10% to about 30% by weight of said liquid bottom fraction is introduced into said second heat exchanger.

6. A process in accordance with claim 1 wherein said liquid bottom fraction introduced into said second heat exchanger is at a temperature of about −225° F. and a pressure of from about 15 psia to about 25 psia.

7. A process in accordance with claim 1 wherein said vapor fraction introduced into said second heat exchanger is at a temperature of from about −260° F. to about −220° F. and a pressure of from about 14 psia to about 55 psia.

8. A process in accordance with claim 1 wherein said processed vapor fraction entering said second heat exchanger is at a temperature of from about 60° F. to about 125° F. and a pressure of from about 24 psia to about 89 psia.

9. A process in accordance with claim 1 wherein said substantially pure liquid methane product is at a temperature of from about −255° F. to about −220° F. and a pressure of from about 22 psia to about 87 psia.

10. A process in accordance with claim 1 wherein the total work provided in compressing said vapor fraction exiting from said second heat exchanger is from about 0.032 to about 0.053 horsepower per pound/per hour of said liquid natural gas feed stream.

11. A process in accordance with claim 1 wherein the first heat exchanger and the second heat exchanger are parts of the same heat exchanger assembly.

* * * * *